United States Patent [19]

Tanaka

[11] Patent Number: 4,827,986

[45] Date of Patent: May 9, 1989

[54] HARNESS SKIP DETECTING METHOD IN DOBBY

[75] Inventor: Tadashi Tanaka, Ohtsu, Japan

[73] Assignee: Murata Kikai Kabushiki Kaisha, Kyoto, Japan

[21] Appl. No.: 73,992

[22] Filed: Jul. 16, 1987

[30] Foreign Application Priority Data

Jul. 24, 1986 [JP] Japan ..... 61-174222

[51] Int. Cl.[4] ..... D03D 51/20

[52] U.S. Cl. ..... 139/337; 139/338

[58] Field of Search ..... 139/336 R, 337, 338, 139/66 R, 76, 435

[56] References Cited

U.S. PATENT DOCUMENTS 4,441,528 4/1984 Julich ..... 139/337

4,446,893 5/1984 Gunneman et al. ..... 139/435

*Primary Examiner*—Henry S. Jaudon

*Attorney, Agent, or Firm*—Spensley Horn Jubas & Lubitz

[57] ABSTRACT

A method for detecting a harness skip in a dobby in which operations of a heald frame during one cycle of a pattern in a weaving machine are detected and stored, then subsequently detected signals on the heald frame are compared with the stored signals.

13 Claims, 3 Drawing Sheets

HARNESS SKIP DETECTING METHOD IN DOBBY

FIELD OF THE INVENTION AND RELATED ART STATEMENT

This invention relates to a dobby.

A dobby which controls the shedding motion of a heald frame using a pattern card to determine the pattern of a textile fabric has heretofore been known.

In the above conventional dobby, the heald frame sometimes fails to perform the shedding motion predetermined by the pattern card from various causes, for example, poor mechanical adjustment, damage of the pattern card, or vibration of the weaving machine. In this case, there occurs broken design of the fabric generally called harness skip, resulting in deterioration of the fabric quality. The ratio of occurrence of such harness skip is, for example, once per about 50 m in terms of the length of fabric, once per about 200,000 in terms of the number of times of pattern card reading, or once per 17 hours or so in terms of working hours. It requires much time and labor to inquire into the cause of such trouble occurring at such a very small probability and take a countermeasure. On the other hand, moreover, the fabric of such harness skip is rejected from the point of quality standard, and in some case it is treated as a substandard article in the unit of "a roll (piece) of cloth" including the portion of harness skip.

OBJECT AND SUMMARY OF THE INVENTION

It is an object of the present invention to propose a method for detecting a harness skip in a dobby by detecting operations of a heald frame.

According to the present invention, operations of a heald frame during one cycle of a pattern in a weaving machine are detected and stored, then subsequently detected signals on the heald frame are compared with the said stored signals.

If the motion of the heald frame is judged to be correct from the result of the above comparison, the operation of the weaving machine including the dobby is continued, while in the event of trouble in the motion of the heald frame, the weaving machine is turned off.

DETAILED DESCRIPTION OF PREFERRED EMBODIMENTS

Figure 1:
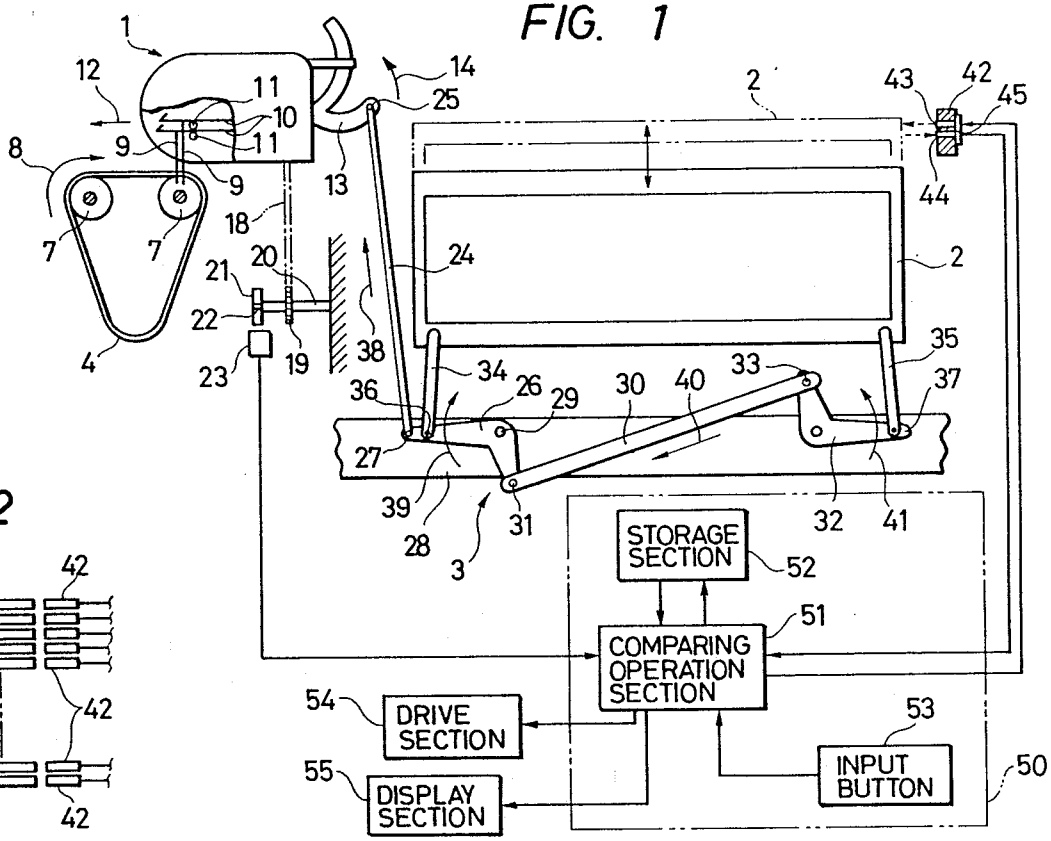
FIG. 1 is a schematic construction diagram showing an embodiment of the present invention.
Figure 2:
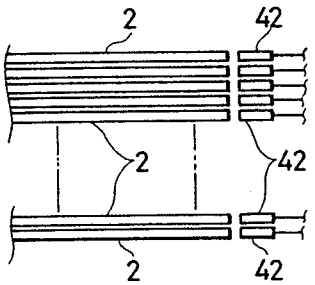
FIG. 2 is a plan view showing a heald frame and a heald frame read sensor.

FIG. 1 shows a dobby according to an embodiment of the present invention. Numerals 1 and 2 denote a dobby and a heald frame, respectively, which are interconnected through a motion transfer member 3.

In the dobby 1, numeral 4 represents a perforated pattern card for imparting predetermined vertical motions to the heald frame 2, decided according to a fabric pattern. The pattern card 4 is fed intermittently in the direction of an arrow 8 two pitches (corresponding to two interhole spacings) at every turn of a pattern card support member 7. Numerals 9 and 10 denote a hook and a needle, respectively. The needles 10 are respectively fixed to the hooks 9. Each hook 9 moves vertically in accordance with a vertical movement of the support member 11. If there is a hole in the pattern card 4 when the hook 9 descends, the hook 9 falls into the holes, while in the absence of a hole, the hook 9 stays on the pattern card 4. When the hook 9 falls into the hole, the needle 10 fixed to the hook 9 does not move even if there is made an attempt to move it in the direction of an arrow 12. According to the illustrated construction, if the needle 10 does not move in the direction of the arrow 12, a rocking lever 13 associated with the needle 10 rocks in the direction of an arrow 14, while the movement of the needle 10 does not cause rocking of the rocking lever 13. The vertical movement of the hook 9, that is, the vertical movement of the support member 11, is transmitted through a belt 18 to a pulley 19 to cause a rotating motion of the latter, resulting in that a detecting disc 21 coaxial at 20 with the pulley 19 is rotated. A metallic piece 22 is fixed to a part of the circumference of the disc 21 and it is detected by a proximity switch 23 as a timing sensor, whereby the timing of a vertical movement of the hook 9 can be detected.

The motion transfer member 3 will now be explained. To the fore end of the rocking lever 13 is pivotally connected one end of an upright connecting bar 24, the other end of which is pivotally connected at 27 to the fore end of one arm of a first rocking piece 26 which is generally L-shaped. The first rocking piece 26 is pivotally secured at 29 to a base 28, and to the fore end of the other arm of the rocking piece 26 is pivotally secured at 31 one end of a horizontal connecting bar 30. The other end of the connecting bar 30 is pivotally connected at 33 to the fore end of one arm of a second rocking piece 32 which is generally L-shaped. To one arm of each of the first and second rocking pieces 26 and 32 are pivotally connected supporting bars 34 and 35 at 36 and 37, respectively, the supporting bars 34 and 35 are fixed to the lower end of the heald frame 2.

As the rocking lever 13 rocks in the direction of the arrow 14, the connecting bar 24 moves upward along an arrow 38; the first rocking piece 26 pivots clockwise along an arrow 39; the horizontal connecting bar 30 moves in the direction of an arrow 40; and the second rocking piece 32 pivots counterclockwise along an arrow 41. With the pivotal movements of the first and second rocking pieces 26 and 32, the supporting bars 34 and 35 move upward to cause an upward movement of the heald frame 2.

A sensor 42 for reading a vertical movement of the heald frame is mounted near an upper side face of the heald frame 2. The sensor 42 is a photo sensor comprising a light emitting element 43 and a light sensing element 44 both provided on a printed board 45. It is disposed in the vicinity of each heald frame 2 which is provided in a plural number in a parallel arrangement.

Input signals from the sensor 42 and the proximity switch 23 are fed to a comparing operation section 51 of a harness skip detector 50. The detector 50 is composed of the comparing operation section 51, a storage section 52 and an input button 53 for setting the number of picks in one cycle. Further, a stop command signal is provided from the comparing operation section 51 to a drive section 54 and a display section- 55 of the weaving machine. The "one cycle" referred to above indicates a single fabric pattern which is repeated by the dobby.

Figure 3:
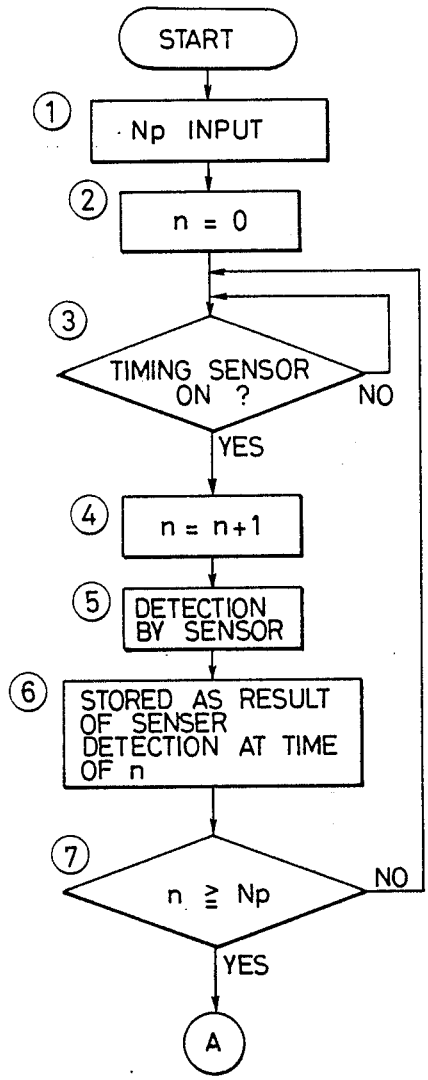
FIG. 3 is a flow chart showing a flow of operations of a comparing operation section.
Figure 4:
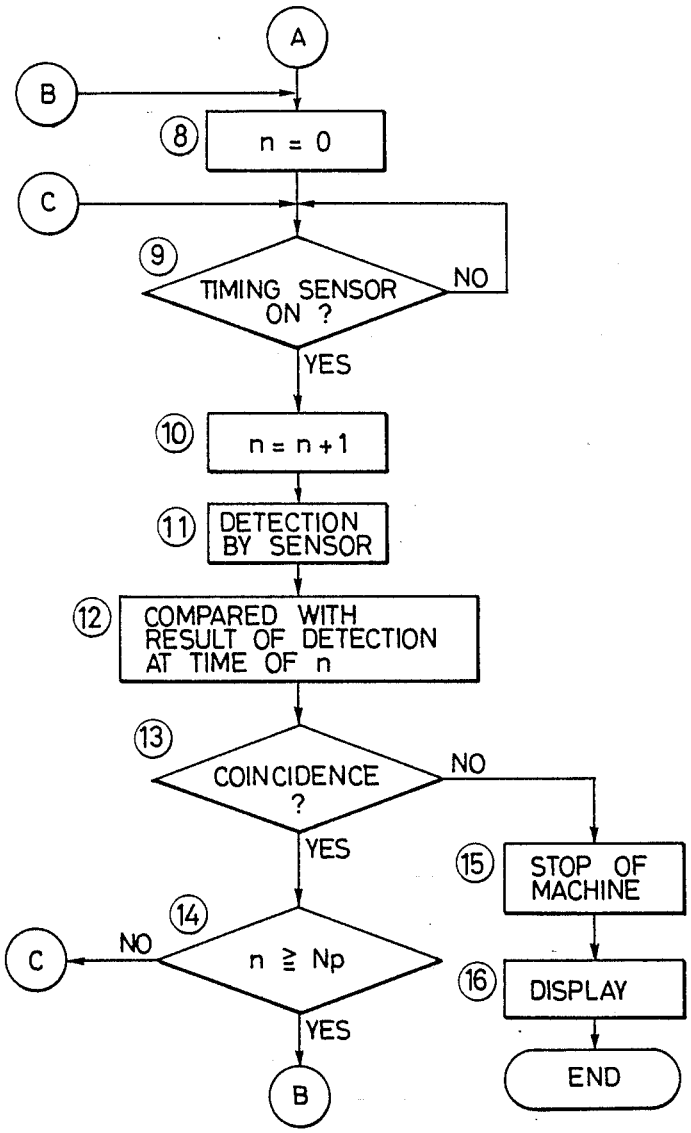
FIG. 4 is also a flow chart thereof

The harness skip detection in the dobby constructed as above is performed in the following operation sequence. The following description is based on the flow charts of FIGS. 3 and 4 showing processing flows of the comparing operation section 51.

(1) The number of picks (Np) in one cycle is input from the input button 53. Where there is no change in the number of picks, for example, when the pattern card is not changed, it is not necessary to input again, of course (step ①).

(2) The pick sequence number (n) is set to "0" (step ②), then after the detection of a one pick movement of the pattern card (4) from the timing sensor 23 (step ③), the pick sequence number (n) is increased by "1" (step ④).

(3) Whether there is any upward movement of the heald frame 2 is detected by the sensor 42 (step ⑤) and the result of the detection is stored in the storage section 52 as the result of the sensor detection at the time of n (step ⑥).

(4) The above operations (steps ③ - ⑥) are repeated until the pick sequence number (n) becomes equal to the present number of picks (Np) (step ⑦). In the storage section 52 are stored the results of detection from the sensor 42, from n = 1 up to n = Np, that is, the data (Da) concerning whether there is any upward movement of the heald frame 2.

(5) If data (Db) from n=1 up to n=Np are again detected and compared with the above data (Da), then stored as the data (Da) in the storage section 52 upon coincidence of both data, though not shown in the flow charts of FIGS. 3 and 4, the reliability of the data (Da) will be further enhanced. By the above operations there is collected information of whether there is present a hole of the pattern card in one cycle, followed by harness skip detection using the said information.

(6) ,The pick sequence number (n) is set to "0" again (step ⑧) and there is made detection of a one pick movement of the pattern card 4 from the timing sensor 23 (step ⑨), thereafter the pick sequence number (n) is increased by "1" (step ⑩).

(7) Whether there is any upward movement of the heald frame 2 is detected by the sensor 42 (step ⑪) and the result of the detection is compared with the result of detection at the time of n stored in the storage section 52 (step ⑫). Upon coincidence of the two (step ⑬), the above operations (steps ⑨ - ⑬) are repeated until the pick sequence number (n) becomes equal to the preset number of picks (Np) (step ⑭).

(8) Upon reaching n–Np (step ⑭), the operations are repeated from step ⑧ and there is made detection again from the beginning of one cycle.

(9) Unless there is obtained coincidence in step ⑬, that is, if there is the possibility of harness skip, the drive section 54 of the weaving machine is turned off (step ⑮) and the harness skip is displayed (step ⑯).

The above operations are performed in all of the heald frames arranged in plural rows. If the number of the heald frame 2 which is in abnormal condition and the frequency of occurrence of such abnormal condition are stored, those data can be utilized as checking data and display is made, showing which heald frame was in abnormal condition. So the checking time can be shortened. Moreover, the apparatus used in the above embodiment can be applied independently of the kind of dobby.

According to the embodiments of the present invention, as set forth hereinabove, the defect of a textile fabric attributable to broken design caused by malfunctions of shedding motions at large including a dobby, such as that mentioned previously, can be overcome and it is possible to expect a textile product of high grade beforehand.

What is claimed is:

1. A method of operating a dobby according to a predetermined pattern, said method comprising the steps of:

detecting the operation of heald frames for one cycle of the pattern;

storing the operation of each heald frame detected for one cycle of the pattern;

detecting the operation of the heald frames for a subsequent cycle of the pattern;

comparing the stored operation of the heald frames detected for one cycle of the pattern with the operation of the heald frames detected for a subsequent cycle of the pattern; and providing a control signal upon noncoicidence of the stored operation and the operation for a subsequent cycle.

2. A harness skip detecting method as claimed in claim 1, wherein said detecting operation of a heald frame is performed by a photosensor for reading a vertical movement of the heald frames comprising a light emitting element and a light sensing element both provided on a printed board.

3. A harness skip detecting method as claimed in claim 2, wherein said detecting operation of a heald frame is further performed by detecting a timing of a vertical movement of a hook in a dobby.

4. A harness skip detecting method as claimed in claim 3, wherein said timing of the vertical movement of a hook is detected by transmitting the vertical movement of a hook through a belt to a pulley to cause a rotating motion thereof and detecting a metallic piece fixed on a circumference of a detecting disc supported coaxially with said pulley.

5. A method of operating a dobby according to a predetermined pattern, said method comprising the steps of:

detecting the operation of a heald frame for one cycle of the pattern;

storing the operation of a heald frame detected for one cycle of the pattern;

detecting the operation of a heald frame for a subsequent cycle of the pattern;

comparing the stored operation of the heald frame detected for one cycle of the pattern with the operation of the heald frame detected for a subsequent cycle of the pattern;

wherein said step of detecting the operation of a heald frame for one cycle of the pattern comprises the steps of:

(1) inputting the number of picks (Np) in one cycle of the pattern;

(2) setting a pick sequence number (n) to zero;

(3) detecting a movement of one pick of the pattern;

(4) increasing the pick sequence number (n) by one:

(5) detecting the upward movement of the heald frame for the pick sequence number (n); and (6) repeating steps 3 through 5 until the pick sequence number (n) equals the number of picks (Np) in one cycle of the pattern.

6. A method according to claim 5, wherein said step of storing the operation of a heald frame detected for one cycle of a pattern comprises the steps of:

storing the result of the detection of the upward movement of the heald frame for each pick sequence number (n).

7. A method according to claim 6, wherein said step of detecting the operation of a heald frame for a subsequent cycle comprises the steps of:

(1) setting the pick sequence number (n) to zero;

(2) detecting a movement of one pick of the pattern;

(3) increasing the pick sequence number (n) by one;

(4) detecting the upward movement of the heald frame for the pick sequence number (n); and (5) repeating steps 1–4 until the pick sequence number (n) equals the number of picks (Np) in one cycle of the pattern.

8. A method according to claim 7, wherein said step of comparing the stored operation of a heald frame for one cycle of the pattern with the operation of the heald frame detected for a subsequent cycle of the pattern comprises the step of:

comparing the result of the detection of step 4 of claim 8 for each pick sequence number (n) with the stored result for the corresponding pick sequence number (n).

9. A method according to claim 8, further comprising the steps of:

stopping the weaving machine upon noncoincidence of the results compared in claim 8.

10. A method according to claim 9, further comprising the step of:

displaying an indication of harness skip upon noncoincidence of the results compared in claim 9.

11. A system for operating a heald frame according to a number of repeated cycles of a predetermined pattern, said system comprising:

detecting means for detecting the operation of the heald frame for one cycle of the pattern, and for detecting the operation of the heald frame for subsequent cycles of the pattern;

storage means for storing the operation of the heald frame detected for one cycle of the pattern;

comparing means for comparing the stored operation of the heald frame detected for one cycle of the pattern with the operation of the heald frame detected for the subsequent cycles of the pattern; and control signal providing means for providing a control signal upon noncoincidence of the stored operation and the operation for the subsequent cycles.

12. A system as claimed in claim 11, further comprising:

stopping means for stopping the operation of the heald frame upon noncoincidence of the operations compared by said comparing means.

13. A system as claimed in claim 11, further comprising:

display means for providing a display upon noncoincidence of the operations compared by said comparing means.

* * * * *